United States Patent [19]

Cantwell et al.

[11] Patent Number: 4,766,614

[45] Date of Patent: Aug. 30, 1988

[54] VENTILATED PROTECTIVE HEADGEAR

[76] Inventors: Jay S. Cantwell, 15 Depaul Hills Ct., Bridgeton, Mo. 63044; William R. Burkett, 6718 Dale Ave., St. Louis, Mo. 63139

[21] Appl. No.: 948,230

[22] Filed: Dec. 31, 1986

[51] Int. Cl.[4] ..... A42B 3/00; A42C 5/04

[52] U.S. Cl. ..... 2/414; 2/420; 2/171.3; 2/419

[58] Field of Search ..... 2/171.3, 171.4, 411, 2/414, 415, 417, 419, 420, 425

[56] References Cited

U.S. PATENT DOCUMENTS

| | | | |
|---|---|---|---|
| 3,208,080 | 9/1965 | Hirsch | 2/414 |
| 3,248,738 | 5/1966 | Morgan | 2/414 |
| 3,529,306 | 9/1970 | Thorne | 2/411 |
| 3,877,076 | 4/1975 | Summers et al. | 2/414 |
| 3,925,821 | 12/1975 | Lewicki | 2/425 |
| 4,024,586 | 5/1977 | Lamb | 2/414 |
| 4,223,409 | 9/1980 | Lee | 2/411 |
| 4,239,106 | 12/1980 | Aileo | 206/223 |
| 4,290,149 | 9/1981 | Aileo | 2/414 |
| 4,345,338 | 8/1982 | Frieder et al. | 2/414 |
| 4,404,690 | 9/1983 | Farquharson | 2/420 |
| 4,434,514 | 3/1984 | Sundahl et al. | 2/425 |
| 4,534,068 | 8/1985 | Mitchell et al. | 2/414 |
| 4,558,470 | 12/1985 | Mitchell et al. | 2/414 |

FOREIGN PATENT DOCUMENTS

| | | | |
|---|---|---|---|
| 96148 | 12/1983 | European Pat. Off. | 2/411 |

*Primary Examiner*—Peter Nerbun

*Attorney, Agent, or Firm*—Grace J. Fishel

[57] ABSTRACT

A lightweight protective headgear having ventilating qualities and having an outer shell, an elastomeric liner with a plurality of elastomeric members arranged with airspace therebetween and a porous material to keep the wearer's hair from filling the airspace between said elastomeric members. The elastomeric members have a base and a surface tapering towards a truncated apex and are arranged in a loosely fitted side by side pattern with their small ends directed axially inward for engaging the head of a wearer and with their large ends engaging the inside of the outer shell. The elastomeric members vary in height to conform the liner to the wearer's head and are arranged along the inside of the outer shell in front to back rows having greater spacing between the rows than between the elastomeric members in the rows.

4 Claims, 2 Drawing Sheets

VENTILATED PROTECTIVE HEADGEAR

The present invention relates to improved protective headgear.

BACKGROUND OF THE INVENTION

Protective headgear having a hard outer shell for use in various sporting, military and industrial applications is well known in the art. In such headgear, an elastomeric liner is generally provided between the outer shell and the wearer's head to help absorb shock but available headgear of this kind is generally too hot and heavy to be comfortably worn.

SUMMARY OF THE PRESENT INVENTION

Accordingly, an important object of the present invention is to provide lightweight protective headgear with improved ventilating qualities which is noticeably more comfortable to wear. Other objects and features of the invention will be in part apparent and in part pointed out hereinafter.

BRIEF DESCRIPTION OF THE DRAWINGS

The above objects and advantages of the invention will be more clearly understood by reference to the accompanying drawings in which one of various possible embodiments of the invention is illustrated and in which corresponding reference characters refer to corresponding parts and in which.

DETAILED DESCRIPTION OF THE INVENTION

Figure 1:
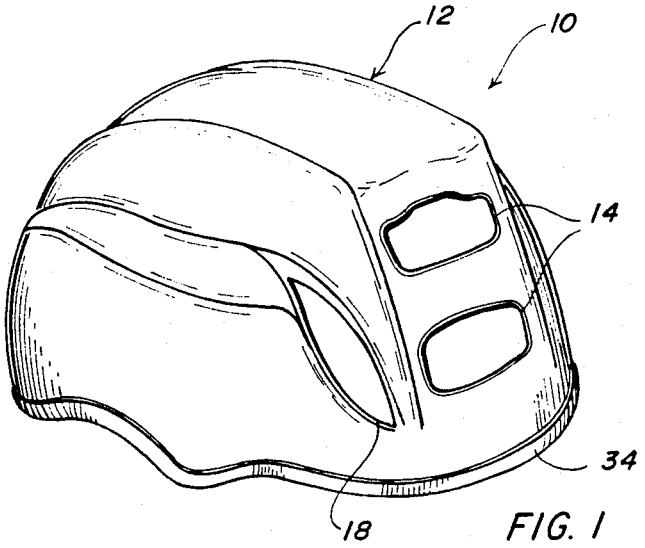
FIG. 1 is a perspective view of a headgear in accordance with the present invention.
Figure 2:
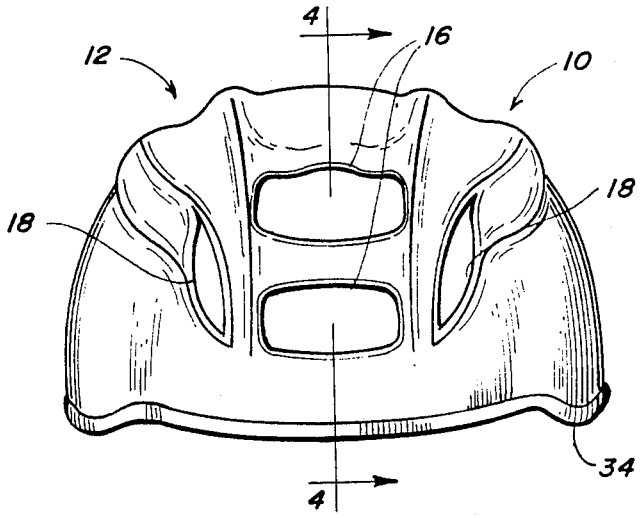
FIG. 2 is a front elevational view thereof.
Figure 3:
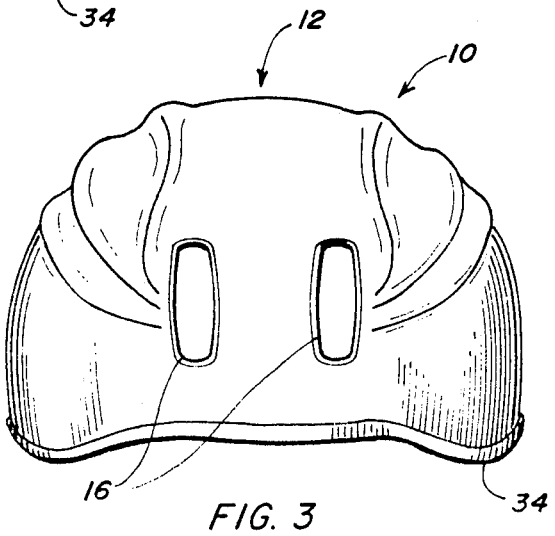
FIG. 3 is a rear elevational view thereof.

Referring to the drawings more particularly by reference character and firstly more particularly to FIGS. 1–3, a protective headgear 10 is shown comprising an outer impact-receiving shell 12 of substantially rigid material, such as resin-impregnated fiber glass or the like. Front, rear and temple apertures 14, 16 and 18, respectively, are preferably formed in headgear 10 providing a ventilative pathway for airflow through the headgear as more particularly described hereinafter.

Figure 4:
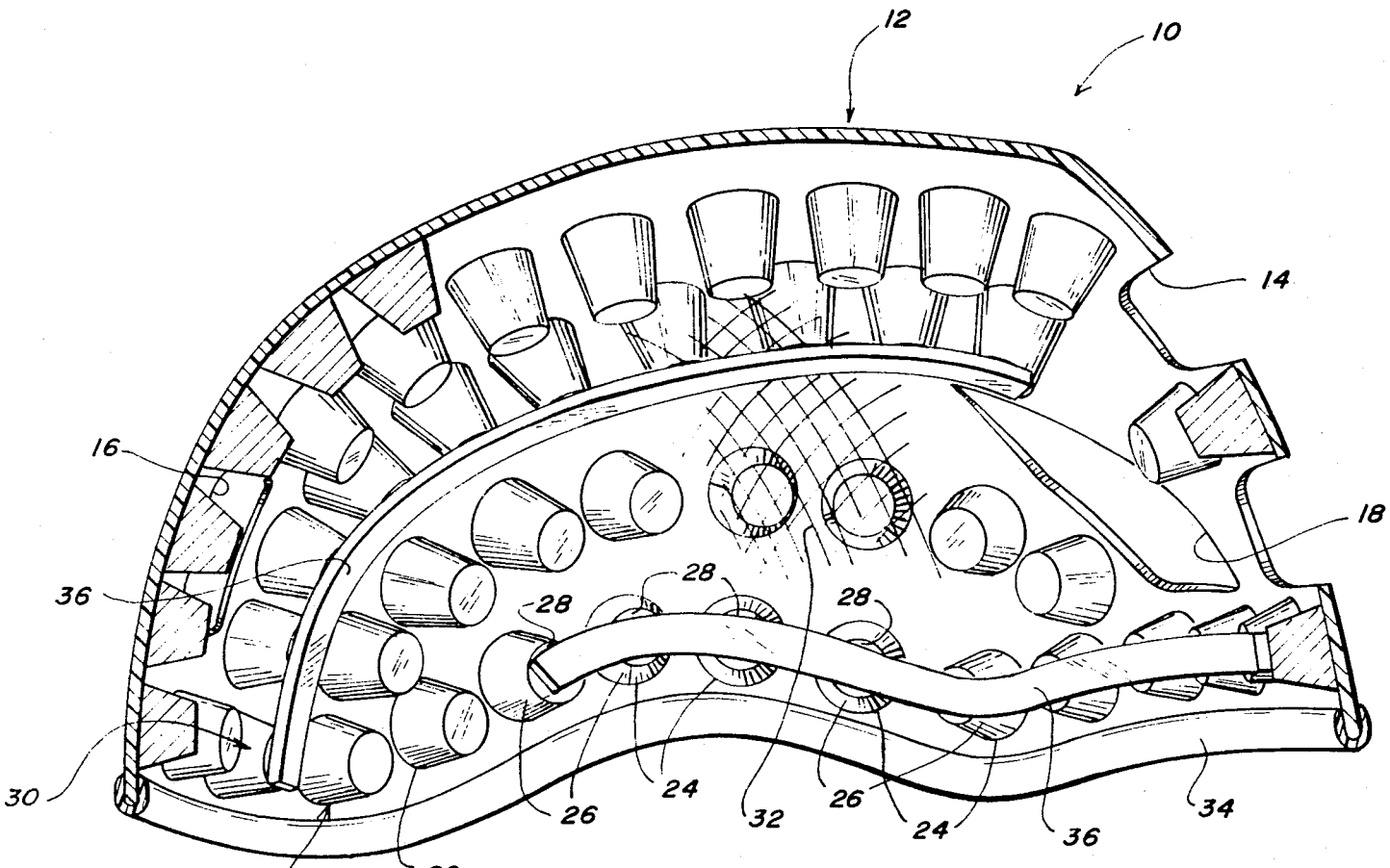
FIG. 4 is a sectional view taken along line 4—4 in FIG. 2.

As shown in FIG. 4, an elastomeric liner 20 for attenuating shock in accordance with the present invention comprises a plurality of elastomeric members 22 having a base 24 and a surface 26 tapering towards a truncated apex 28 and arranged along the inner wall of outer shell 12. Base 24 may be generally curved or polygonal but for ease of fabrication or for reasons of esthetics, elastomeric members 22 are preferably conical, as illustrated, or pyrimidal in shape with square-cut end faces. Elastomeric members 22 must be able to effectively attentuate the shock resulting from a relatively large impact force, yet optimally should be as short and small as possible to minimize bulk and weight.

With continuing reference to FIG. 4, it is seen that elastomeric members 22 are arranged in a loosely fitted side by side pattern with their small ends directed axially inward for engaging the head of a wearer and with their large ends engaging the inside of the outer shell. Members 22 are elastically deformable in the radial direction and are formed of an elastomeric material such as a foamed polystyrene or the like. Members 22 may be individually formed and attached to the inner wall of outer shell 12, either fixedly (e.g, with glue) or removably for reconditioning the headgear by replacing damaged sections. Alternatively, members 22 may be formed, for example by casting, and attached as unit. The height of members 22 is also made to vary, being shorter around the lower edge of shell 12, and longer towards the top, to conform liner 20 to the wearer's head.

As shown in FIG. 4, members 22 are preferably arranged in front to back rows 30 having greater spacing between the rows for airflow through the headgear. As shown, rows 30 are in registry with apertures 14, 16 and 18 and, with respect to temple aperture 18, the space between the rows in the lateral region above the wearer's temple is particularly wide for cooling the wearer's head at that point.

A porous material 32 such as netting covers elastomeric liner 20 as a hair retainment means to keep the wearer's hair from filling the air space between members 22 and interfering with the airflow through apertures 14, 16 and 18. When material 32 is bonded to the truncated end of each member 22, material 32 also serves to distribute the load laterally to adjacent members 22 in the event of impact. The free edge of porous material 32 is caught by and the lower edge of shell 12 finished with pinch molding 34.

In use, protective headgear 10 may be stabilized and secured to a wearer's head in any conventional manner such as a chin strap (not shown). Final sizing of headgear 10 is accomplished with foamed strips 36 which may be provided with the headgear in several thicknesses for installation by the wearer. As shown in FIG. 4, strips 36 are bonded to porous material 32 along selected rows 30 of elastomeric members 22 at the front and at the rear of the hat.

Protective headgear 10 is cooler and lighter to wear than available headgear. It may be used for various sporting, military and industrial applications but is particularly useful in those situations where coolness and lightness are most prized as for example by touring cyclists. The invention, however, can be used by skate boarders, motorcyclists or by anyone needing protective headgear who is appreciative of headgear which is lightweight and has improved ventilating qualities.

In view of the above, it will be seen that the objects of the invention are achieved and other advantageous results obtained. As various changes could be made in the subject headgear without departing from the scope of the invention, it is intended that all matter contained in the above description shall be interpreted as illustrative and not in a limiting sense.

What is claimed is:

1. A lightweight protective headgear having improved ventilating qualities comprising:

a unitary outer shell of substantially rigid material, said outer shell having front and rear apertures;

an elastomeric liner for attenuating shock comprising a plurality of elastomeric members having a base and a surface tapering towards a truncated apex and arranged in a loosely fitted side by side pattern with their small ends directed axially inward for engaging the head of a wearer and with their large ends engaging the inside of the outer shell, said elastomeric members varying in height to conform the liner to the wearer's head and arranged along the inside of the outer shell in front to back rows having greater spacing between the rows than between the elastomeric members in said rows for airflow through the headgear; and, a porous material covering the elastomeric liner whereby air may circulate through the porous material and between the elastomeric members.

2. The headgear of claim 1 wherein the porous material is bonded to the truncated apex of the elastomeric members whereby the porous material distributes the load laterally to adjacent members in the event of impact.

3. The headgear of claim 1 wherein the outer shell has temple apertures and wherein the spacing between the rows of elastomeric members in the lateral region above the wearer's temple is wider than the spacing elsewhere.

4. The headgear of claim 3, wherein the rows of elastomeric members are in registry for airflow with the front, rear and temple apertures.

* * * * *